US006935904B2

(12) United States Patent
Ishiyama

(10) Patent No.: US 6,935,904 B2
(45) Date of Patent: Aug. 30, 2005

(54) CONNECTOR

(75) Inventor: Takayuki Ishiyama, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/855,219

(22) Filed: May 27, 2004

(65) Prior Publication Data

US 2004/0242083 A1 Dec. 2, 2004

(30) Foreign Application Priority Data

May 28, 2003 (JP) ..... 2003-150876

(51) Int. Cl.[7] ..... H01R 13/436
(52) U.S. Cl. ..... 439/752; 439/744
(58) Field of Search ..... 439/752, 595, 439/599, 744

(56) References Cited

U.S. PATENT DOCUMENTS 4,867,711 A * 9/1989 Yuasa ..... 439/752
5,252,096 A * 10/1993 Okada ..... 439/752
5,299,958 A * 4/1994 Ohsumi ..... 439/752
5,464,356 A * 11/1995 Nebeshima et al. ..... 439/752
5,516,308 A * 5/1996 Yamanashi ..... 439/752
5,839,923 A * 11/1998 Yoshida ..... 439/752
5,865,653 A 2/1999 Okada et al. ..... 439/752

* cited by examiner

*Primary Examiner*—Hien Vu
(74) *Attorney, Agent, or Firm*—Gerald E. Hespos; Anthony J. Casella

(57) ABSTRACT

A housing (10) has cavities (11, 12) and a groove (40) that crosses cavities (11, 12). A retainer (50) is inserted into the groove (40) for locking terminal fittings (30) in the cavities (11, 12). The groove (40) is open in an insertion surface (IS) of the housing (10) through which the retainer (50) is inserted, and opposite side surfaces of the housing (10) substantially normal to the insertion surface (IS). Bridges (70) span the opening of the groove (40). The bridges (70) support the housing (10) against compressing forces that might otherwise plastically the housing (10).

8 Claims, 10 Drawing Sheets

COMPARATIVE EXAMPLE

CONNECTOR

BACKGROUND OF THE INVENTION

1. Field of the Invention

The invention relates to a connector with a side retainer.

2. Description of the Related Art

U.S. Pat. No. 5,865,653 discloses a connector with a housing that has a plurality of cavities for accommodating terminal fittings. A window hole is formed in one side surface of the housing, and a gate-shaped retainer is mountable in the window hole to lock the terminal fittings. The gate-shaped retainer crosses over the housing and has side pieces that add to the width of both the housing and the connector.

FIG. 13 shows a connector with a housing 1 that has a window hole 2 for receiving a gate-shaped retainer 3. The window hole 2 is open at three sides of the housing 2, namely, an inserting side of a retainer 3 and sides normal to the inserting side. The retainer 3 has side pieces that serve as the sidewalls of the housing 1. Thus, the connector is narrower. However, the absence of the sidewalls at the window hole 2 makes the housing 1 weaker, and the housing 1 may resiliently deform when a compressing force acts in the direction of the arrow in FIG. 13. This deformation can narrow the width of the window hole 2 when the retainer 3 is not mounted.

The retainer 3 is displaceable between a partial locking position and a full locking position reached by inserting the retainer deeper than the partial locking position. The terminal fittings can be inserted and withdrawn when the retainer 3 is at the partial locking position. However, the terminal fittings are locked when the retainer 3 is at the full locking position. The retainer 3 may be moved inadvertently from the partial locking position to the full locking position by a small force, such as an impact, when the terminal fittings are not inserted.

The present invention was developed in view of the above problems and an object thereof is to ensure a sufficient strength of a housing.

SUMMARY OF THE INVENTION

The invention relates to a connector with a housing formed with one or more cavities for accommodating terminal fittings. A groove is formed in the housing and communicates with the cavities, and a retainer is insertable into the groove to lock the terminal fittings. The groove is open in a first surface of the housing through which the retainer is inserted and in the opposite side surfaces of the housing that extend angularly from the first surface. Bridges are provided on the opposite side surfaces of the housing and cross the opening of the groove. The bridges span the groove and support the housing against forces that could otherwise deform the housing in directions that could narrow the width of the groove.

The retainer includes a pushing portion and arms at opposite ends of the pushing portion. Thus, the retainer is mountable to cross over the housing.

The arms may partially engage the housing to keep the retainer at a first position where the terminal fittings can be inserted and withdrawn. The retainer is kept at the first position when the terminal fittings are not inserted. The retainer can be pushed after the terminal fittings are inserted. This pushing generates an outward opening movement of the arms and cancels the partial engagement of the arms with the housing. Thus, the retainer can be moved to a second position where the terminal fittings are locked. Accordingly, the retainer is prevented from inadvertently moving from the first position to the second position.

Slides preferably are provided on inner side surfaces of the bridges and are disposed for sliding contact with the retainer as the retainer moved from the first position to the second position. The slides permit outward opening movements of leading ends of the arms when a proper pushing force is given to the pushing portion. However, the slides prevent outward opening movements of the base ends of the arms.

The bridges on the housing preferably are fit into and guided by guiding grooves of a mating connector, thereby guiding the housing to a proper connection position with the mating connector.

Intermediate parts of the bridges facing the groove preferably are thinned to accommodate the retainer.

The retainer preferably comprises an abutting portion that contacts a mating portion of the housing and is stopped thereby to prevent the retainer from being inserted in the mounting direction beyond the second position.

A retainer support may be formed inside the groove and may be stepped from and substantially continuous with the outer edge of the housing.

The retainer preferably is mounted in a mounting direction aligned at an angle to an inserting direction of the terminal fittings into the housing, and preferably a substantially right angle.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
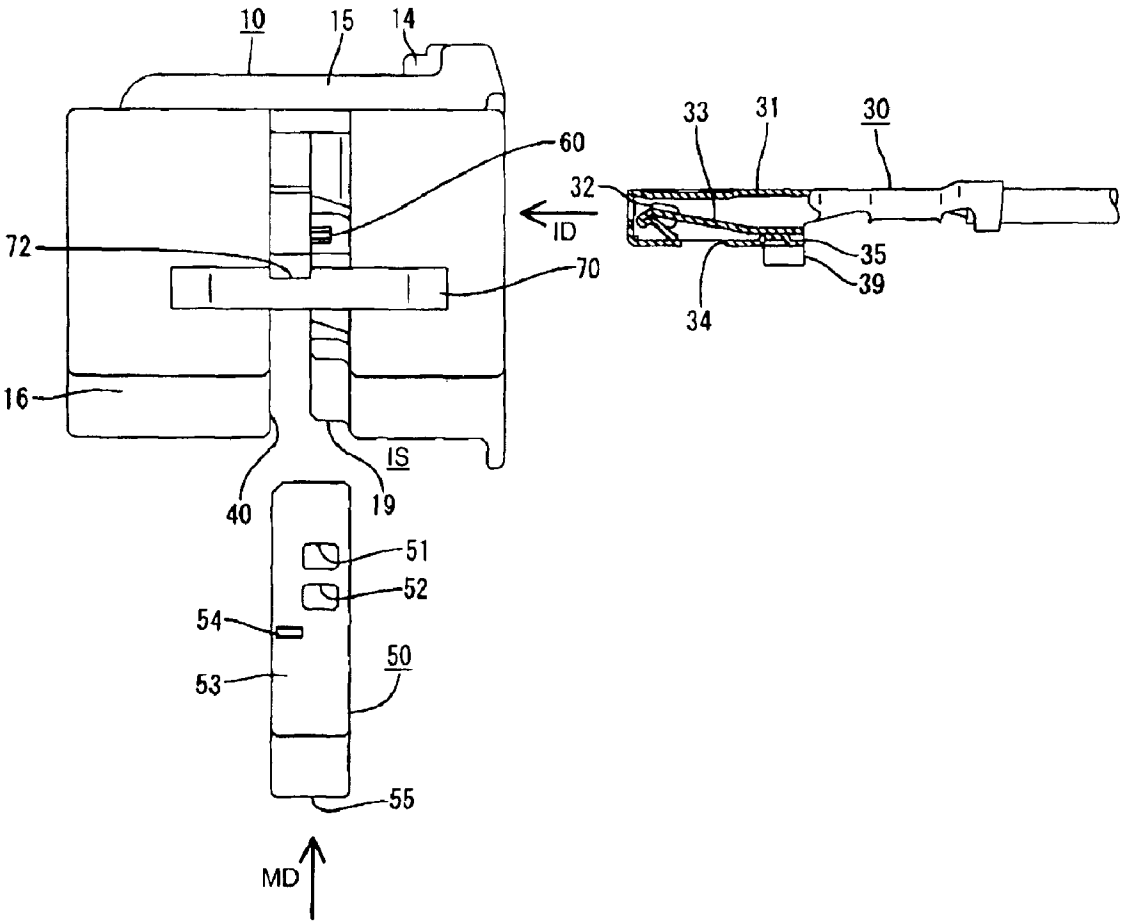
FIG. 1 is an exploded side view of a connector according to one embodiment of the invention.

A female connector according to the invention includes a housing identified by the numeral 10 in FIG. 1. The housing 10 is made unitarily e.g. of a synthetic resin and is connectable with a male housing (not shown) of a mating male connector. In the following description, sides of the male and female housings to be connected are referred to as the front sides.

Figure 2:
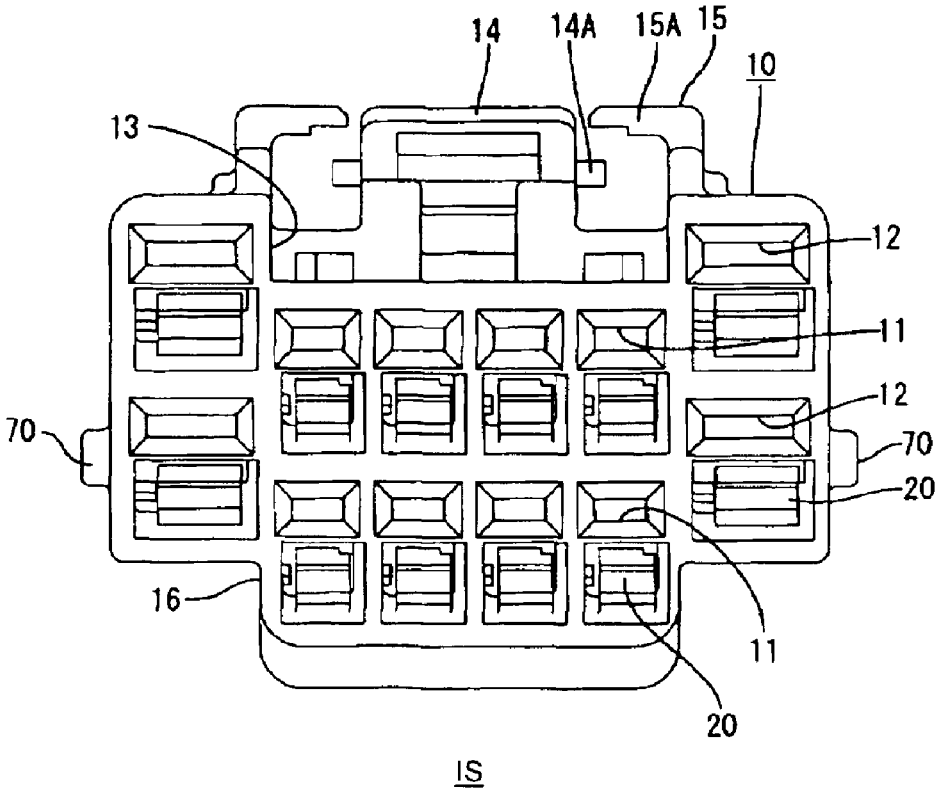
FIG. 2 is a front view of a housing.

As shown in FIG. 2, the housing 10 is of a hybrid type and has small cavities 11 for receiving small terminal fittings and large cavities 12 for receiving large terminal fittings. The small cavities 11 are at upper and lower stages in a widthwise middle part of the housing 10. The large cavities 12 are at upper and lower stages at the opposite lateral sides of the housing 10. A recess 13 is formed in a portion of the upper surface of the housing 10 corresponding to the small cavities 11, and a resiliently deformable lock arm 14 is cantilevered on the bottom surface of the recess 13. The lock arm 14 is to be engaged with a mating engaging portion (not shown) when the male and female housings are connected, thereby locking the male and female housings together. Bulging pieces 14A project at opposite sides of the leading end of the lock arm 14. Parallel protection walls 15 are formed on upper surface of the housing 10 at opposite sides of the lock arm 14, and a preventing wall 15A projects in from the leading end of each protection wall 15. The preventing walls 15A engage the bulging pieces 14A to prevent excessive deformation of the lock arm 14.

A projection 16 is provided at a widthwise middle part of the bottom surface of the housing 10 and projects down and out by the depth of the recess 13. Resiliently deformable locks 20 are cantilevered from the inner walls of the cavities 11, 12 for engaging and locking the terminal fittings 30.

Each terminal fitting 30 is a female terminal fitting with a substantially box-shaped main portion 31 at its front mating side, as shown in FIG. 1. A resilient contact piece 33 is formed inside the main portion 31 by bending, folding and/or embossing and has a contact 32 for mating with male terminal fitting (not shown). A locking hole 34 penetrates the bottom wall of the main portion 31 and receives the lock 20. A jaw 35 and a stabilizer 39 are formed at the rear end of the main portion 31. The lock 20 fits into the locking hole 34 of the terminal fitting 30 when the terminal fitting 30 is inserted into the cavity 11, 12 from behind the housing 10 and along an insertion direction ID, thereby partly locking the terminal fitting 30. The retainer 50 then is engages the stabilizer 39 and the jaw 35 of the terminal fitting 30 to fully lock the terminal fitting 30. As a result, a returning movement of the terminal fitting 30 is prevented. FIG. 1 shows the small terminal fitting 30 and the large terminal fitting is not shown. However, the large terminal fittings have substantially the same construction except a size difference.

Figure 3:
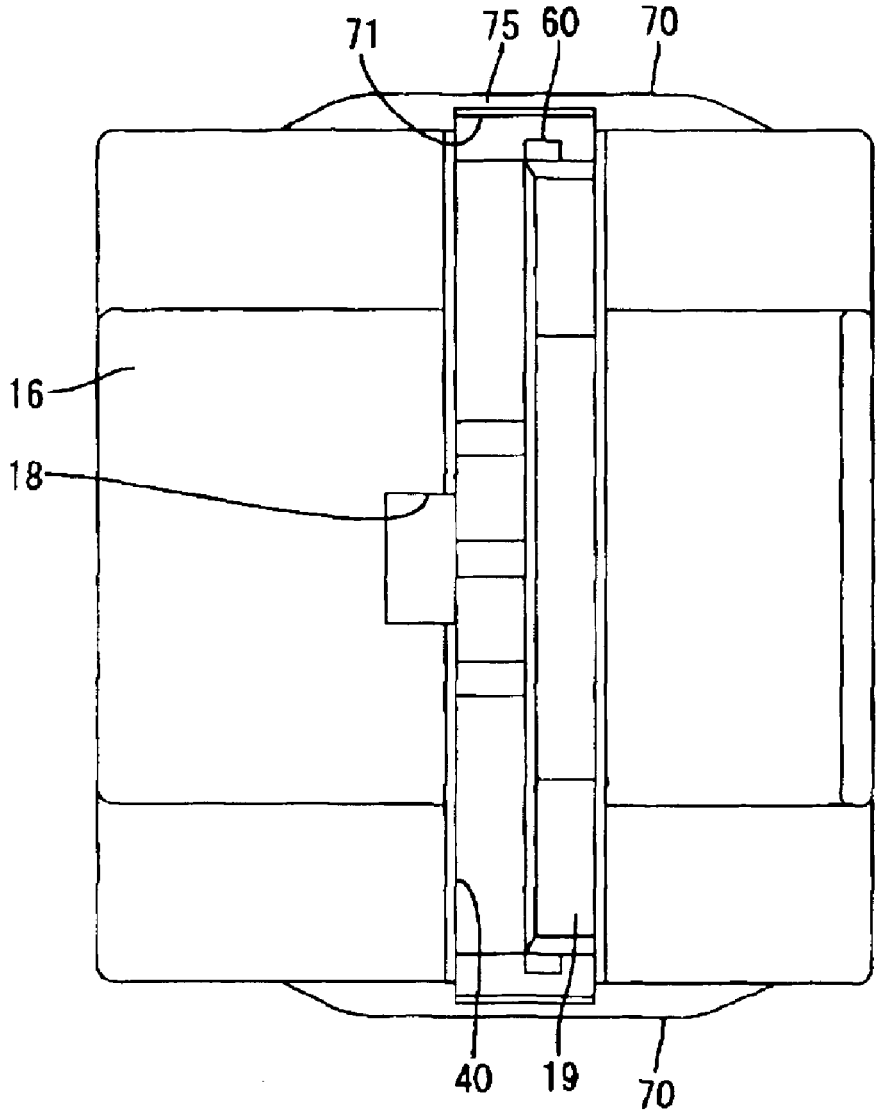
FIG. 3 is a bottom view of the housing.

The housing 10 has a groove 40 that opens in the bottom and the opposite side surfaces of the housing 10 and at least partly crosses the cavities 11, 12. The retainer 50 is closely insertable into the groove 40. More particularly, the groove 40 is substantially in the longitudinal middle of the housing 10 and is open an inserting side IS of the retainer 50 and two sides substantially normal to the inserting side IS. As shown in FIG. 3, a jig guide 18 is formed in the bottom surface of the housing 10 and extends oblique to a mounting direction MD of the retainer 50 and oblique to the inserting direction ID so that at least the rear end of the jig guide 18 communicates with the groove 40. The retainer 50 can be detached easily from the groove 40 by inserting a jig (not shown) into the jig guide 18. A retainer support 19 is formed inside the groove 40 and is stepped from and substantially continuous with the outer edge of the housing 10. Engaging portions 60 project from substantially opposite side surfaces of the retainer support 19. Upper and lower surfaces of the engaging portions 60 are slanted and guide the retainer 50 during movement over the engaging portions 60.

Figure 4:
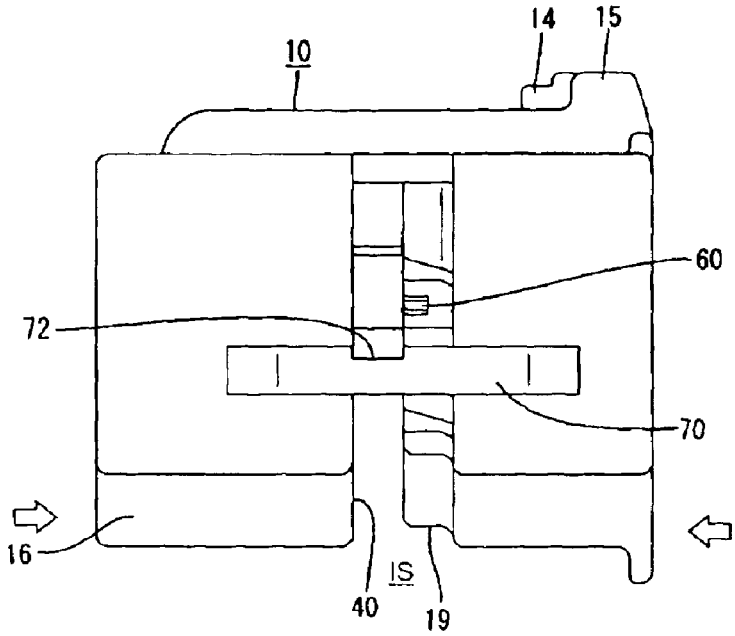
FIG. 4 is a side view of the housing.

Left and right bridges 70 are formed unitarily on opposite side walls of the housing 10 and cross the front and rear side walls separated by the groove 40, as shown in FIG. 4. The bridges 70 cross the groove 40 substantially at right angles and project slightly out from the outer walls of the housing 10 along the lateral direction so that the retainer 50 is arranged inside the bridges 70. Thinned portions 75 are formed at intermediate parts of the bridges 70 facing the groove 40, as shown in FIG. 3, and permit the retainer 50 to escape. Ends of the bridges 70 at opposite ends of the thinned portions 75 are thicker and are unitarily continuous with the housing 10. A sliding portion 71 is provided on an inner side surface of the thinned portion 75 of each bridge 70, and an engaging recess 72 is formed by cutting at the upper end of each bridge 70.

Figure 5:
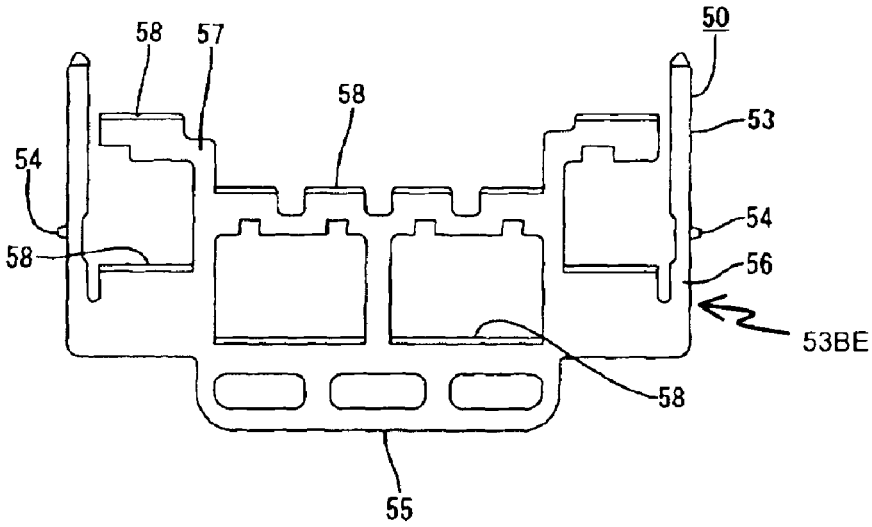
FIG. 5 is a front view of a retainer.
Figure 6:
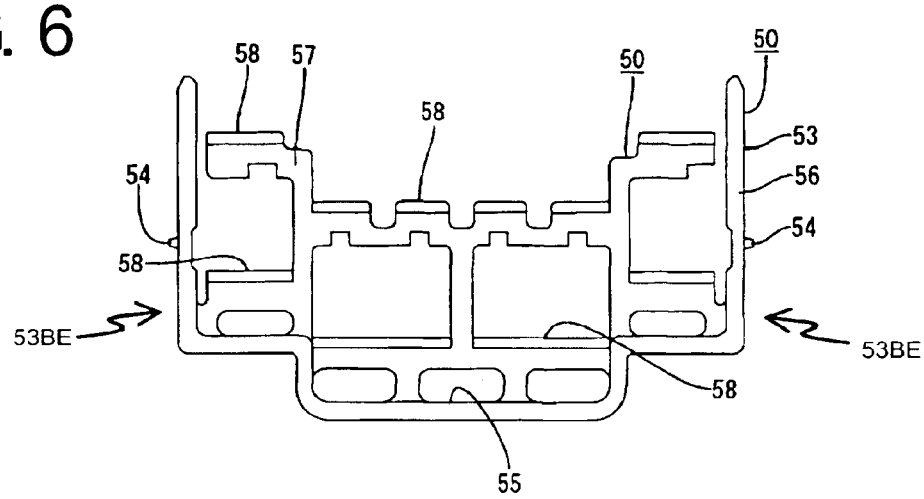
FIG. 6 is a rear view of the retainer.

The retainer 50, as shown in FIGS. 5 and 6, has a pair of arms 53 projecting from opposite ends of a pushing portion 55. The arms 53 and the pushing portion 55 define a substantially gate-shaped outer frame 56 dimensioned for crossing over the housing 10. The retainer 50 also has an inner frame 57 substantially continuous with the outer frame 56 and arranged to cross the cavities 11, 12 in the housing 10. The outer frame 56 of the mounted retainer 50 is substantially flush with the side walls of the housing 10 and serves as partial wall surfaces of the housing 10.

Figure 10A:
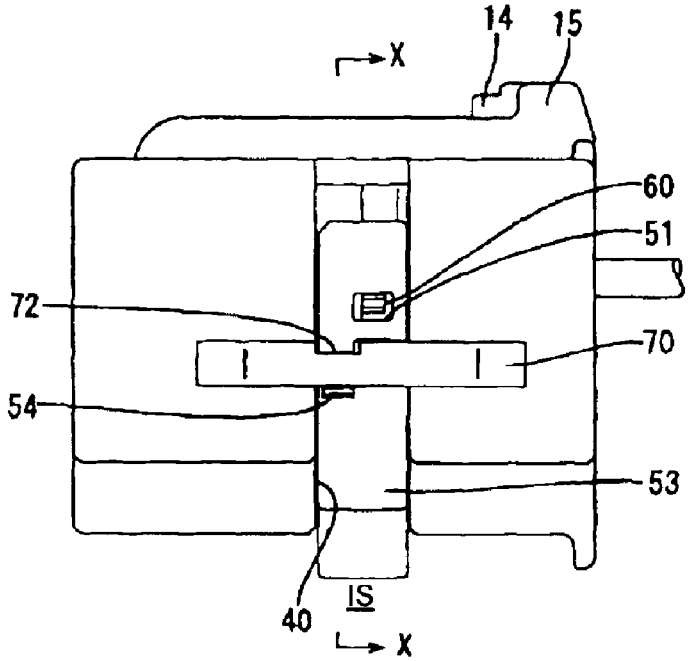
FIG. 10(A) is a side view of the connector when the retainer is at the partial locking position, and 10(B) is a section along 10B—10B of FIG. 10(A).
Figure 10B:
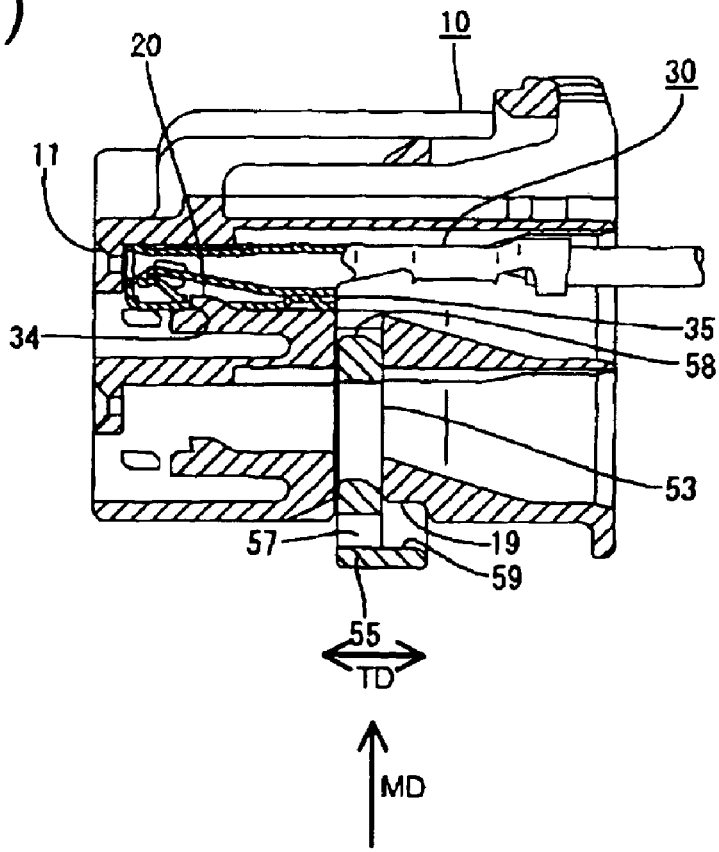

Locking projections 58 are provided in the inner frame 57 to engage the jaws 35 and lock the terminal fittings 30. The inner frame 57 is formed at a front half of the outer frame 56 with respect to the thickness direction TD, as shown in FIG. 10(B). An inserting portion 59 is formed at a rear half of the outer frame 56 with respect to thickness direction TD and can be placed on the retainer support 19 of the housing 10. The inserting portion 59 contacts the retainer support 19 and is stopped to prevent the retainer 50 from being inserted in the mounting direction MD beyond a full locking position.

Figure 7:
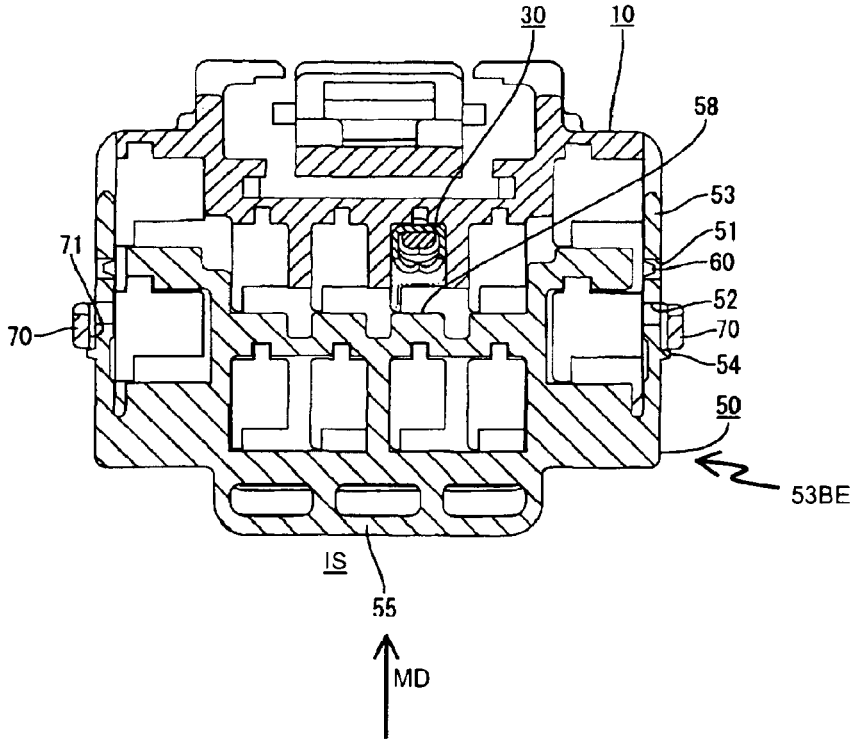
FIG. 7 is a vertical section of the connector when the retainer is at a partial locking position.
Figure 9:
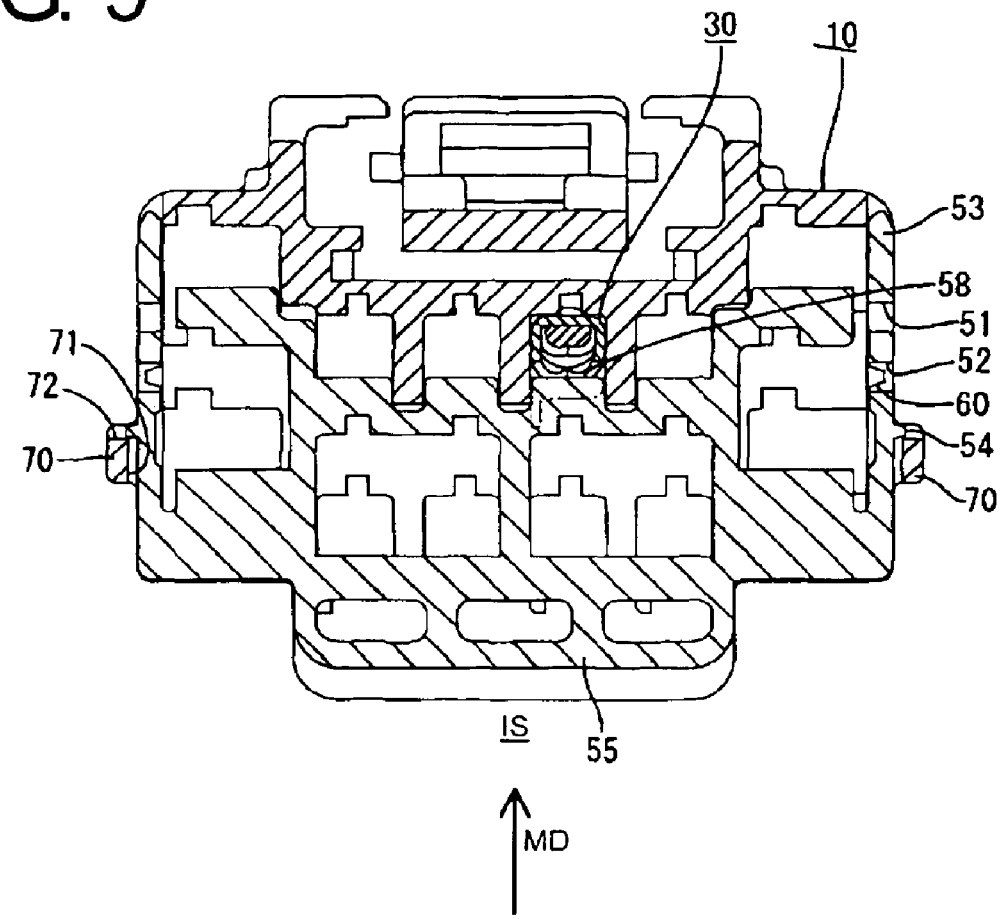
FIG. 9 is a vertical section of the connector when the retainer is at the full locking position.
Figure 11A:
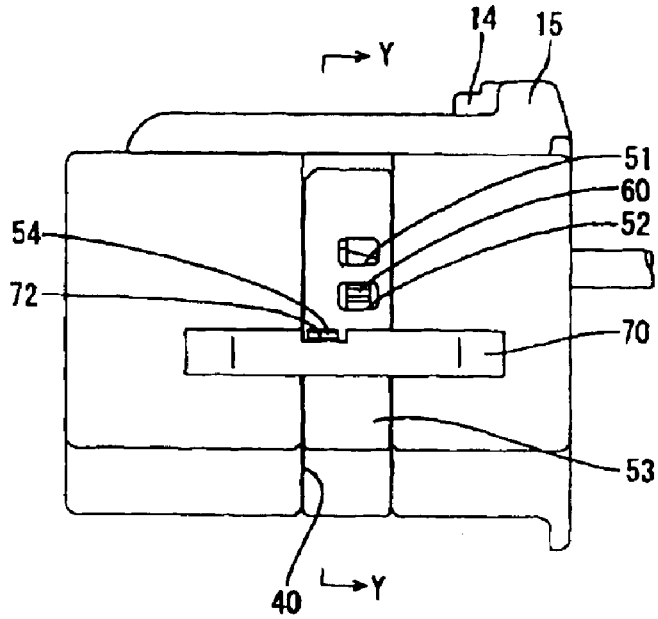
FIG. 11(A) is a side view of the connector when the retainer is at the full locking position, and 11(B) is a section along 11B—11B of FIG. 11(A).
Figure 11B:
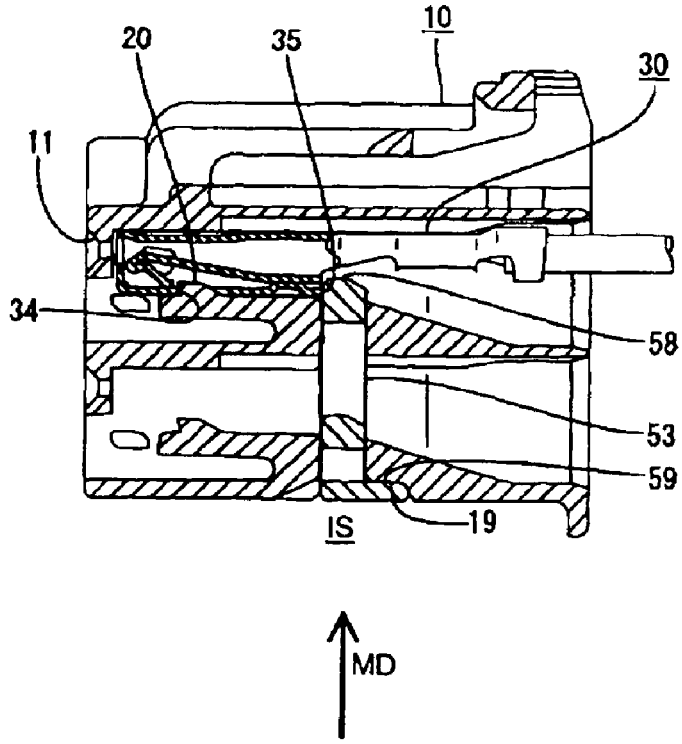

The partial lock 51 and the full lock 52 successively penetrate each arm 53 of the retainer 50 along a mounting direction MD of the retainer 50. The partial locks 51 engage the engaging portions 60 of the housing 10 when the retainer 50 is inserted lightly into the groove 40. Thus, the retainer 50 is held at a partial locking position (state shown in FIGS. 10(A), 10(B) and 7) where insertion and withdrawal of the terminal fittings 30 into and from the cavities 11 12 are permitted. On the other hand, the full locks 52 engage the engaging portions 60 instead of the partial locks 51 when the retainer 50 is pushed in the mounting direction MD with a proper pushing force. Thus, the retainer 50 is held at a full locking position (state shown in FIGS. 11(A), 11(B) and 9) where the terminal fittings 30 are locked so as not to come out of the cavities 11, 12.

The locks 54 project from the outer walls of the arms 53 of the retainer 50 and contact the bottom edges of the bridges 70 when the retainer 50 is at the partial locking position. Thus, the locks 54 prevent the retainer 50 from inadvertently moving in the mounting direction MD from the partial locking position to the full locking position. On the other hand, the locks 54 fit into the engaging recesses 72 at the upper edges of the bridges 70 when the retainer 50 reaches the full locking position. The upper edges of the locks 54 and the bridges 70 are substantially flush with each other when the locks 54 fit into the engaging recesses 72. Thus, the two housings can be connected smoothly without the locks 54 interfering with the mating male housing.

The retainer 50 initially is inserted lightly in the mounting direction MD into the groove 40 of the housing 10. The pushing portion 55 is pushed in the mounting direction MD in this state to engage the partial locks 51 of the retainer 50 with the engaging portions 60 of the housing 10. As a result, the retainer 50 is partly locked in a first position.

The terminal fittings 30 then are inserted into the cavities 11, 12 without interfering with the locking projections 58 of the retainer 50. Thus, the terminal fittings 30 are locked partly by locks 20 after being inserted to substantially proper positions (see FIGS. 10(A), 10(B) and 7).

Figure 8:
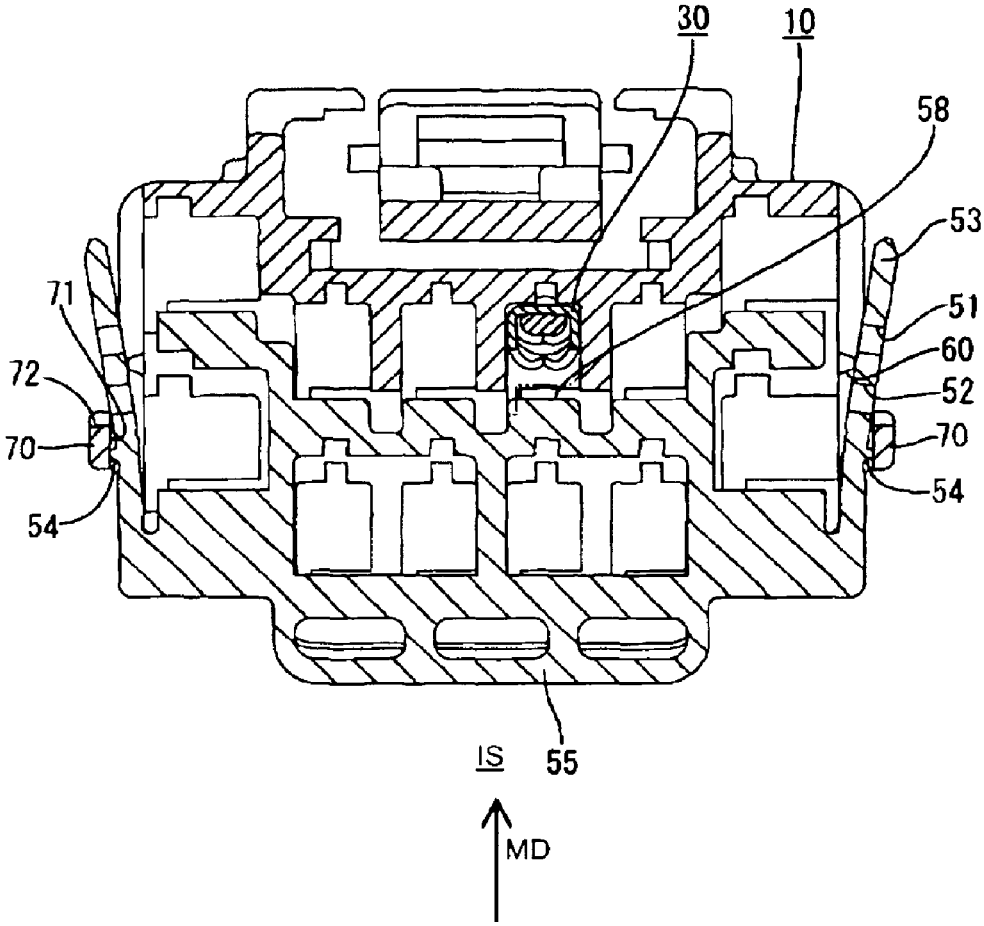
FIG. 8 is a vertical section of the connector showing an intermediate state during a movement of the retainer from the partial locking position to a full locking position.

A proper pushing force is given to the pushing portion 55 in the mounting direction MD to push the retainer 50 to the back side. Thus, the partial locks 51 disengage from the engaging portions 60. Outward opening movements of the arms 53 of the retainer 50 are restricted at base ends 53BE of the arms 53 during the movement of the retainer 50 from the partial locking position towards the full locking position. Thus, the arms 53 are deformed resiliently inward by the sliding contact of the locks 54 with the sliding portions 71 of the bridges 70, as shown in FIG. 8. On the other hand, sections of the arms 53 located more toward the leading ends than the locks 54 move onto the engaging portions 60 and deform outward. The retainer 50 is locked fully when the partial locks 54 disengage from the bridges 70 and the full locks 52 engage the engaging portions 60. The bridges 70 on the housing 10 are fit in and guided by guiding grooves (not shown) of the male housing after the retainer 50 is mounted completely. Thus, the bridges 70 also function to guide the housing 10 to a proper connection position.

A compressing force may act to narrow the width of the groove 40, as indicated by a direction of arrows in FIG. 4, when the retainer 50 is not mounted in the groove 40. However, the bridges 70 cross the opening of the groove 40 at right angles at the opposite side surfaces of the housing 10. Thus, the bridges 70 support and stiffen the housing 10 against a compressing force to hinder deformation of the housing 10. As a result, a plastic deformation of the housing 10 can be avoided.

Figure 12:
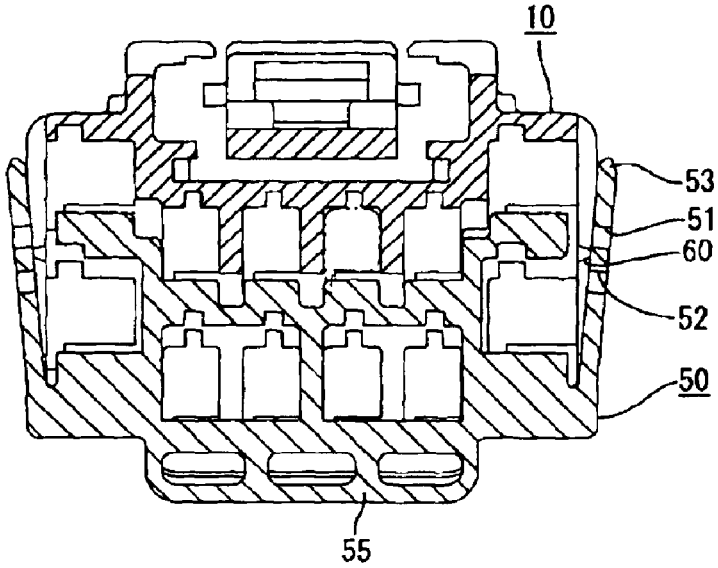
FIG. 12 is a vertical section of a connector as a comparative example when the absence of bridging portions is assumed.
Figure 13:
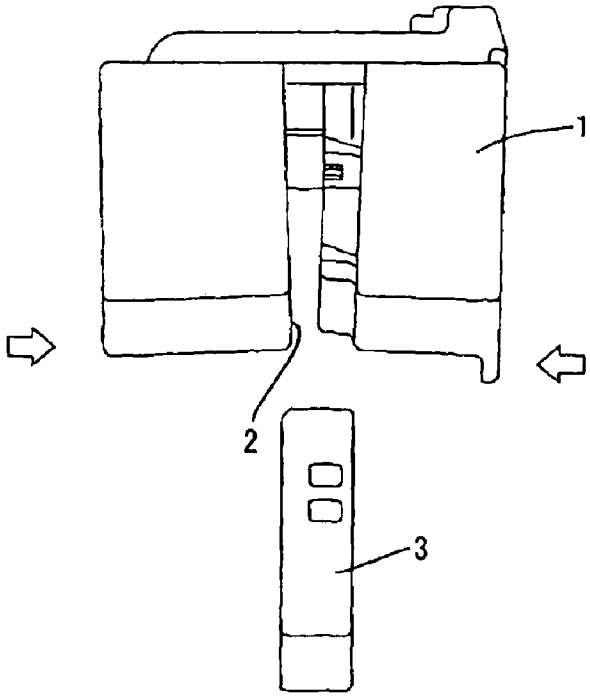
FIG. 13 PRIOR ART
FIG. 13 is an exploded side view of a prior art connector.

If a pushing force smaller than the proper pushing force is given to the pushing portion 55 in the case that the housing 10 is not provided with the bridges 70 as shown in FIG. 12, the retainer 50 easily moves from the partial locking position to the full locking position due to the outward opening movements of the arms 53 from the base ends 53BE thereof. However, in this embodiment, the slides 71 of the bridges 70 engage the base ends 53BE of the arms 53 to prevent the outward opening movements of the arms 53 from their base ends 53BE, even if a light pushing force is given to the pushing portion 55. Thus, the retainer 50 does not inadvertently move from the partial locking position to the full locking position.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the female housing is shown in the foregoing embodiment, the present invention may be applied to male housings.

Although the retainer is provided with the partial locking portions and the full locking portions and the housing is provided with the engaging portions in the foregoing embodiment, the retainer may be provided with the engaging portions and the housing may be provided with the partial locking portions and the full locking portions according to the present invention.

Although the partial and full locking portions are through holes and the engaging portions are projections in the foregoing embodiment, the partial and full locking portions may be projections and the engaging portions may be through holes or recesses according to the present invention.

Although the bridges span the opening of the groove at right angles in the foregoing embodiment, it is sufficient for the bridges to span the opening of the groove according to the present invention.

The retainer may not be provided with the lock portions according to the present invention.

The number of the bridges may be arbitrarily set.

The locking of the terminal fittings in the housing may be established only by the retainer.

According to the invention, there may be provided in total only one bridge bridging the groove on only one side of the housing or three or more bridges provided on either one or both sides of the housing.

What is claimed is:

1. A connector, comprising:

a housing with at least one cavity for accommodating at least one terminal fitting;

a groove formed in the housing and at least partly crossing the cavity, the groove being open in an insertion surface of the housing and in substantially opposite side surfaces of the housing aligned at an angle to the insertion surface, the openings in the opposite sides surfaces having closed ends spaced from the insertion surface;

a retainer insertable in the groove through the insertion surface of the housing to lock the terminal fitting in the cavity, the retainer having a pushing portion and arms at opposite ends of the pushing portion so that the retainer is mounted to cross over the housing; and bridges provided externally on the opposite side surfaces of the housing to cross the openings of the groove at locations spaced from the closed ends of the respective openings in the side surfaces for reinforcing the housing, the bridges extending substantially parallel to the at least one cavity and being partly fitted into and guided by guiding grooves of a mating connector, thereby guiding the housing to a proper connection position with the mating connector.

2. The connector of claim 1, wherein the retainer is movable from a first position on the housing where the terminal fittings can be inserted and withdrawn to a second position where the terminal fittings are locked, the retainer being kept at the first position by partial engagement of the arms with the housing and being movable to the second position by canceling the partial engagement of the arms with the housing.

3. The connector of claim 2, wherein the partial engagement of the arms with the housing is canceled by causing portions of the arms to make outward opening movements.

4. The connector of claim 3, wherein a sliding portion is provided on an inner side surface of each bridge for sliding contact with the arms of the retainer moving from the first position to the second position so that portions of the arms of the retainer are inwardly from the respective bridges, the sliding portion permitting the outward opening movements of leading ends of the arms when a proper pushing force is given to the pushing portion while preventing outward opening movements of the arms from base ends thereof.

5. The connector of claim 1, wherein intermediate parts of the bridges facing the groove are formed into thinned portions for escaping the retainer.

6. The connector of claim 1, wherein the retainer comprises an inserting portion for contacting a retainer support of the housing and preventing the retainer from being inserted in the mounting direction beyond the second position.

7. The connector of claim 6 wherein the mating portion comprises a retainer support in the groove stepped from and substantially continuous with the outer edge of the housing.

8. The connector of claim 1, wherein the retainer is to be mounted in a mounting direction aligned at an angle to an inserting direction of the terminal fitting(s) into the housing.

* * * * *